United States Patent [19]

Schmidt

[11] 4,190,973

[45] Mar. 4, 1980

[54] SNOW BLOWER DEFLECTOR SHIELD

[76] Inventor: Robert D. Schmidt, 31606 Haldane, Livonia, Mich. 48152

[21] Appl. No.: 946,949

[22] Filed: Sep. 29, 1978

[51] Int. Cl.[2] ..... E01H 5/00

[52] U.S. Cl. ..... 37/43 R; 37/43 D

[58] Field of Search ..... 37/43 R–43 L, 37/53, 20–27

[56] References Cited

U.S. PATENT DOCUMENTS

| | | | |
|---|---|---|---|
| 3,359,661 | 12/1967 | Speiser et al. | 37/43 D |
| 3,466,767 | 9/1969 | Rubin | 37/43 R |
| 3,913,247 | 10/1975 | Ruhl | 37/43 R X |
| 4,138,830 | 2/1979 | Chase | 37/43 D |
| 4,138,831 | 2/1979 | Chase | 37/43 D |

*Primary Examiner*—E. H. Eickholt

*Attorney, Agent, or Firm*—Cullen, Sloman, Cantor, Grauer, Scott & Rutherford

[57] ABSTRACT

A snow blower has a framework with a handle, a laterally adjustable vane shifter plate, a series of shiftable upright vanes for delivering streams of snow forwardly and laterally. The improvement, a snow deflector shield assembly which comprises an elongated laterally extending vane cap plate overlying and secured to the vane shifter plate. A flexible arcuate deflector shield along one edge is hingedly connected to said cap plate and overlies said vanes. A pitch-adjusting handle extends at right angles to and at one end is pivotally connected to said deflector shield and intermediate its ends is adjustably anchored upon the framework handle.

11 Claims, 7 Drawing Figures

SNOW BLOWER DEFLECTOR SHIELD

BACKGROUND OF THE INVENTION

The difficulty with conventional snow blowers of the transportable type is that, though the objective is to deliver streams of snow forwardly and laterally of the machine, some of the deflected snow has a tendancy to move rearwardly towards the user of the snow blower partially obstructing his view at times and preventing accurate manual control of the snow blower as it advances over the ground surface.

SUMMARY OF THE INVENTION

It is an object of the present invention to provide a deflector shield assembly for pivotal mounting upon the elongated laterally extending vane cap plate of a snow blower so as to overlie the conventional shiftable vanes which define streams of snow which are deflected forwardly and laterally to provide a continuation of the snow blower side plates and vanes to prevent the rearward deflection of the streams of snow and to improve the forward and lateral direction of said streams of snow.

It is a further object to provide a snow deflector shield which will have a variable and adjustable pitch for the purpose of preventing blow back of snow from 75% to 100% and depending upon weather conditions at time of use.

It is a further object to provide an improved snow deflector shield assembly adapted for power-operated snow blowers, and particularly the well known TORO SNOWMASTER (Snow blower) (Trademark of Toro Company), it being contemplated with modifications, the present assembly may be adapted to other snow-blower machines.

These and other objects will be seen from the following specification and claims in conjunction with the appended drawings.

THE DRAWINGS

DETAILED DESCRIPTION OF THE INVENTION

Figure 1:
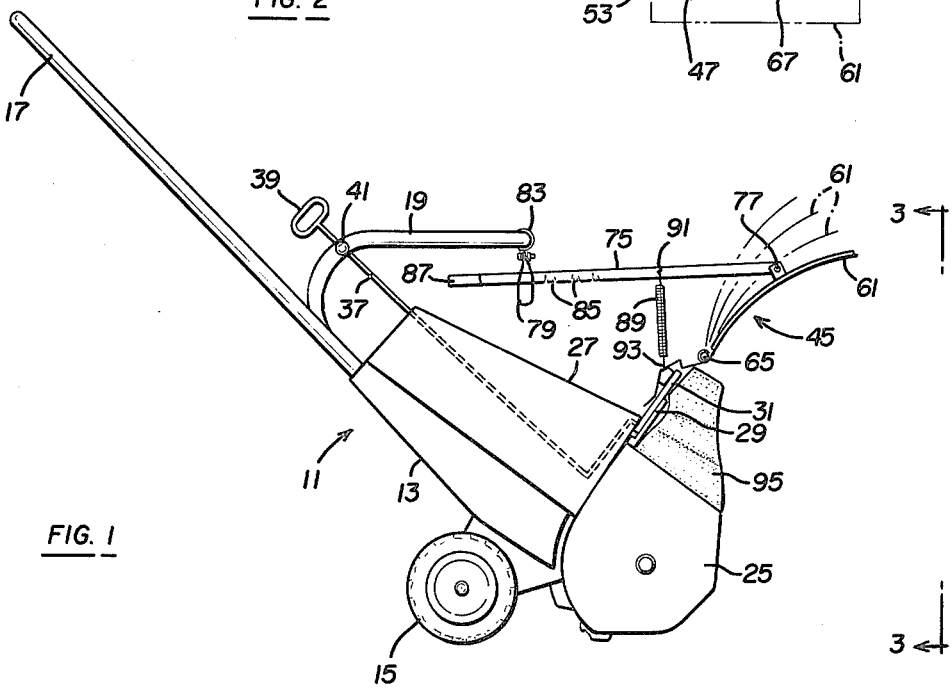
FIG. 1 is a side elevational view of a snow blower with the present adjustable pitch snow deflector shield assembly applied thereto.

Referring to the drawing, a conventional transportable snow blower is shown in FIG. 1 and designated at

11 as including a framework 13 and a pair of wheels 15 and having a U-shaped handle 17.

The framework also includes the horizontally disposed blower lifting handle 19 which is generally of U-shape with depending end portions thereof connected with said framework.

Figure 3:
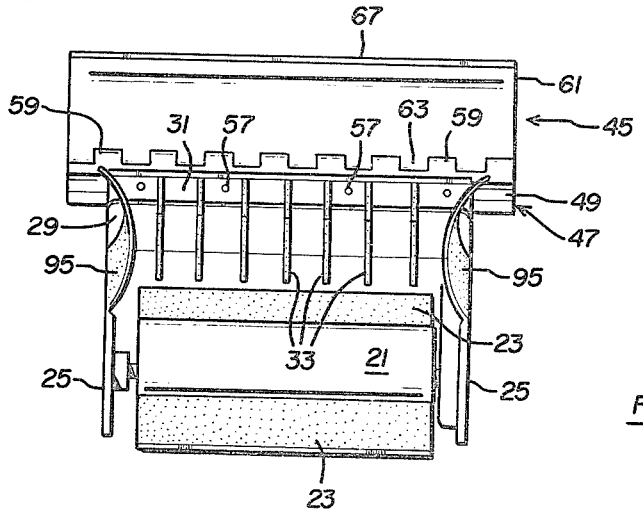
FIG. 3 is a front elevational view thereof taken in the direction of arrows 3—3 of FIG. 1.

The blower mechanism includes a cylindrical power drum 21, FIG. 3, having at least a pair of oppositely directed snow blades 23 of rectangular shape. The snow blower housing 27 includes an upwardly and forwardly inclined mount plate 29 overwhich is supportably positioned a conventional vane shifter plate 31, FIG. 4. A series of upright spaced angularly adjustable flexible vanes 33 are flexibly connected in a conventional manner to a portion of the mount plate 29. Vane shifter plate 31 overlies mount plate 29 and is flexibly and pivotally connected to upper portions of the blades 33 by a series of connectors 35, FIG. 4. Shifter rod 37, FIG. 1, with handle 39 is journalled on bearing 41 mounted upon lift handle 19 and at its right angularly arranged end portion has actuator 43, FIG. 4, connected to the vane shifter plate.

Figure 7:
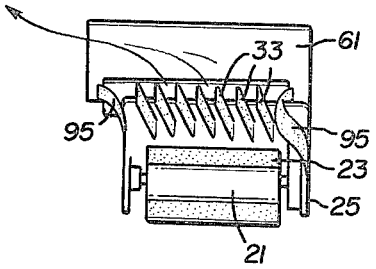
FIG. 7 is a similar view showing the lateral direction of the streams of snow when the vanes are shifted in the opposite direction.
Figure 6:
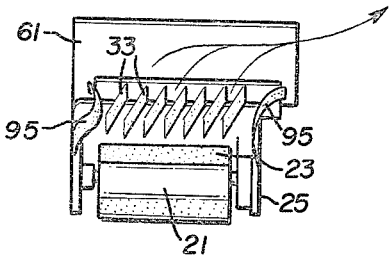
FIG. 6 is a schematic front elevational view similar to FIG. 3 illustrating the general lateral direction of the streams of snow when the vanes have been shifted in one direction.

Manual adjustments of shifter rod 37 cause longitudinal adjustments in one direction or the other of vane shifter plate 31 which, in a conventional manner, causes angular tilting of the respective sets of blades 33 from the central position shown in FIG. 3 to the extreme positions shown in FIGS. 6 and 7 for directing upwardly moving streams of snow between the end plates 25 through the yieldable formed side plates 95 and laterally outward from the blower such as shown by the arrows in FIGS. 6 and 7. This is a conventional construction such as involved in the TORO SNOWMASTER (Trademark) presently on the market and to which the present snow deflector shield assembly is adapted.

SNOW DEFLECTOR SHIELD ASSEMBLY

Figure 2:
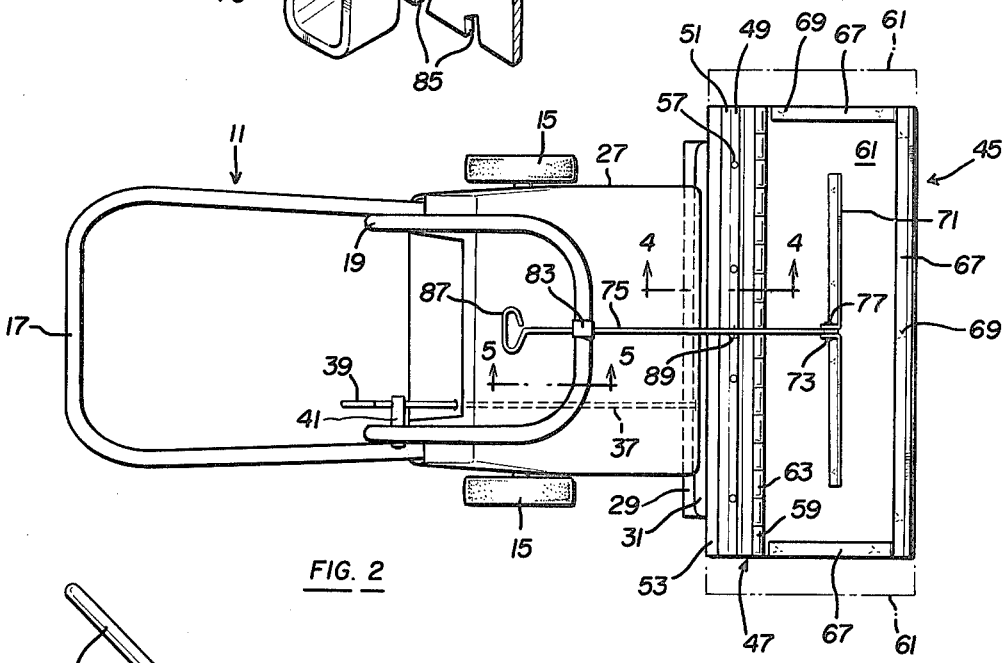
FIG. 2 is a plan view thereof.
Figure 4:
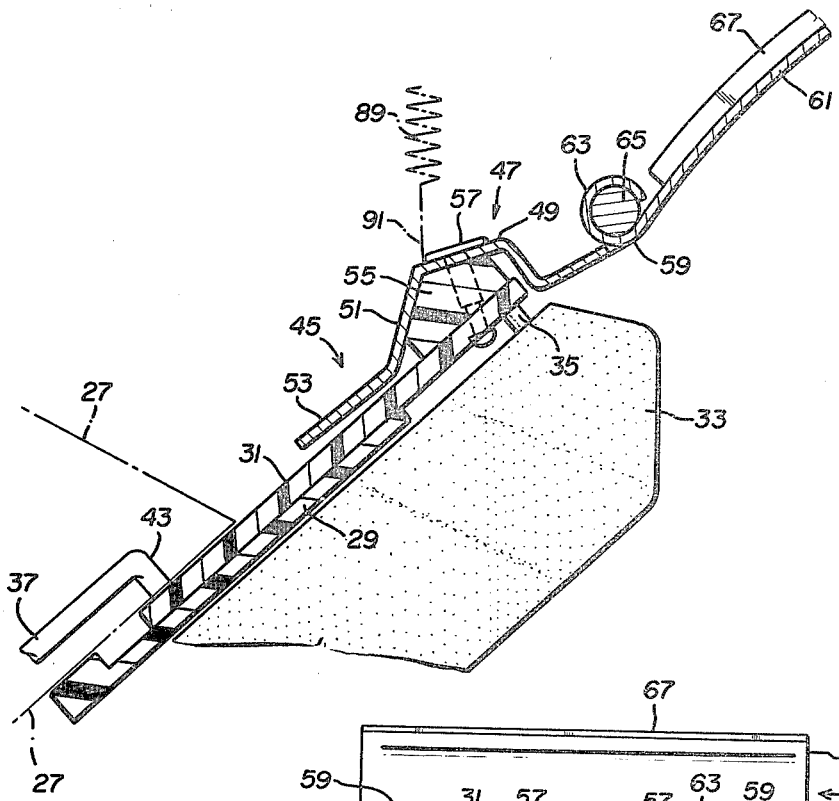
FIG. 4 is a fragmentary transverse section on an increased scale taken in the direction of arrows 4—4 of FIG. 2.

The present snow deflector shield assembly generally indicated at 45, FIGS. 2 and 4, is of a variable pitch construction and is adapted to guidably receive the upwardly moving streams of snow delivered by the snow blower blades 23 through the vanes 33 for further deflecting the snow forwardly and laterally and for the purpose of preventing snow blow-back onto the operator. The present snow deflector shield assembly is a non-clogging device which will prevent blow-back of 75% to 100%, depending on adjustment of its variable pitch and weather conditions at the time of use.

The snow deflector shield assembly includes an elongated vane cap 47 having a top plate 49 which overlies vane shifter 31 and is secured thereto by a series of spacer rivets or fasteners 57. An elongated spacer block 55 of polygonal shape interposed between plate 31 and cap 47 as shown in FIG. 4.

Top plate 49 terminates in angle plate 51 which is arranged at an acute angle thereto and is adapted to cooperatively register with one of the angular sides of spacer block 55, and terminates in the rearwardly and downwardly arranged extension plate 53. The forward longitudinal edge of top plate 49 terminates in a series of longitudinally spaced hinge elements 59.

The present elongated rectangular and flexible variable pitch deflector shield 61 has along one longitudinal edge a series of longitudinally spaced hinge elements 63 which cooperatively register with hinge elements 59 and are interconnected by a suitable hinge pin 65, FIG. 4. Reinforcing elongated edge plates 67 overlie side and leading edge portions of the deflector shield and are suitably secured thereto by fasteners or rivets or by welding as at 69.

A pair of elongated bracket strips 71 are mounted centrally of the shield rearwardly thereof essentially along its center line and suitably secured thereto by fasteners or rivets. Strips 71 terminate in the pair of opposed outturned ends 73. Elongated horizontally disposed variable pitch control handle 75 centrally overlies the housing 27 and at one end is projected between the outturned ends 73 and pivotally connected thereto at 77, FIG. 2.

The variable pitch control handle 75 having a grip 87 at its other end is adjustably supported and mounted upon the handle strap 79 which depends from the tubular lift handle 19 of the snow blower.

For this purpose, the strap 79 is of general U-shape and includes a pair of upwardly converging sides 80 having opposed transverse slots 81 therethrough receiving the handle 75. The handle strap is secured to the lift handle 19 by a suitable clip 83 affixed to said lift handle 19.

Along the underside of the variable pitch control handle 75 are a series of pairs of upwardly and inwardly inclined slots 85 adapted for cooperative interlocking registry with corresponding adjacent portions of the clip sides 80 for securing the handle in turn, the deflector shield 61 at the desired angle of pitch as shown schematically in FIG. 1.

Coiled compression spring 89 is anchored at 91 to said handle intermediate its ends with the opposite end of the spring anchored as at 93 to a portion of the top plate 49, FIG. 4.

In a conventional operation of the snow blower, shown in FIG. 1, power rotation of drum 21 and the semi-rigid blades 23 of rectangular shape, FIG. 3, are adapted to engage the snow as the snow blower is advanced over the ground surface for delivering a plurality of streams of snow upwardly between the vanes 33. These depending upon their angularity, are adapted to deflect the snow forwardly and laterally to one side or the other, as shown by the arrows of FIGS. 6 and 7, depending upon the manually adjusted position of shifter plate 31.

Since the operation of the shifter plate 31 is conventional in this machine now on the market, utilizing the shifter control handle 37-39, further detail of this construction is omitted. Suffice-it-to-say, however, that such manual control is adapted to effect lateral shifting of the vane shifter plate 31 with respect to the underlying mount plate 29. This lateral shifting effects the corresponding lateral shifting of the present vane cap 47 which is secured thereto by the series of fasteners 57. Since the shield 61 is pivotally connected along its lower longitudinal edge to hinge portions 59 along the forward longitudinal edge of the vane cap, such lateral adjustments of the shifter plate cause lateral adjustments of the deflector shield 61, as shown by the dashlines in FIG. 2.

In the normal operation of the snow blower, the drum-operated blades 23 rotate between the end plates 25 for directing the snow upwardly to and between the angularly adjusted vanes 33 which are arranged between the yieldable and formed side plates 95 which, thus, define a throated opening for the upwardly moving streams of snow, FIGS. 6 and 7.

The present snow deflector shield assembly forms a continuation of plates 29 and 31, overlies the vanes 33 and normally extends outwardly of side plates 95 for further deflecting the upwardly moving streams of snow assisting in the transport of said streams of snow either to the right or left of the forwardly moving machine, as best shown in FIGS. 6 and 7.

Figure 5:
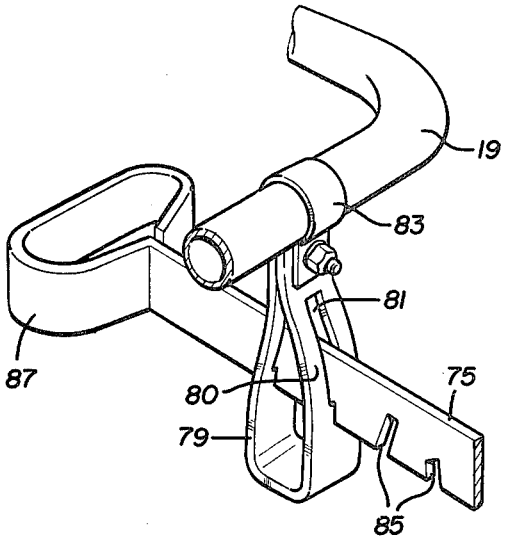
FIG. 5 is a fragmentary front perspective view illustrating the mounting of the pitch-adjusting handle for the shield shown in FIGS. 1 and 2, and on an increased scale.

The present deflector shield is forwardly arcuate throughout its length, as shown in FIG. 1, and its pitch is variably adjustable by the handle 75 which can be secured in a series of longitudinally adjusted positions through handle support strap 79, FIG. 5. In view of such securing of handle 75, and in view of the fixed pivotal connection 77 between said handle and the central portion of the shield 61, upon lateral shifting of the shield to either extreme position shown in FIG. 2, there will be a torsional effect upon the shape of said shield, causing a slight twisting thereof so as to decrease the radius of curvature of the shield adjacent one end thereof in the direction of shifting and to increase the radius of curvature adjacent the other end. This provides a rifling snorkel effect increasing the velocity of the streams of snow as they pass over surface portions of the arcuate deflector shield.

The present snow deflector shield is automatically adjusted from side to side as the operator adjusts the vanes 33 through the action of the shifter plate 31 and its conventional control handle 37–39. Using the variable pitch control handle 75, the operator can adjust the pitch of the shield 61 in seconds from a standing position behind the machine to compensate for wind velocity or weight of the snow to be removed.

The present deflector shield assembly weighs less than five pounds and its assembly upon the snow blower is quick and extremely easy.

Having described my invention, reference should now be had to the following claims.

I claim:

1. In a transportable snow blower having a framework with a lift handle, a laterally adjustable vane shifter plate, and a series of parallel spaced angularly shiftable upright vanes for delivering streams of snow forwardly and laterally between a pair of side plates;

the improvement of a snow deflector shield assembly comprising an elongated laterally extending vane cap plate overlying and secured to said vane shifter plate and laterally adjustable therewith;

a flexible forwardly arcuate deflector shield along one edge hingedly connected to said cap plate along one edge thereof;

overlying said vanes and extending laterally outward of said side plates;

and a pitch-adjusting handle at right angles to and at one end pivotally connected to said deflector shield and intermediate its ends adjustably supported and anchored upon said framework lift handle.

2. In the snow blower of claim 1, said side plates defining an upright throated opening receiving said streams of snow;

said deflector shield on angular adjustment providing a continuation of said throated opening guiding said streams of snow forwardly and laterally of the snow blower preventing snow blow back of 75% to 100% approximately, depending upon the pitch of said deflector shield and weather conditions.

3. In the snow blower of claim 1, the securing of said vane cap plate to said vane shifter plate including a series of spaced rivets interconnecting said plates.

4. In the snow blower of claim 1, the securing of said vane cap plate to said vane shifter plate including an elongated spacer between said plates, and a series of spaced fasteners extending between said plates and spacer.

5. In the snow blower of claim 4, said spacer being polygonal in cross section;

said vane cap plate having a top plate receiving said fasteners and an angle plate and an obtuse angle thereto in cooperative interlocking registry with said spacer.

6. In the snow blower of claim 1, the hinge connection of said deflector shield including a series of spaced first hinge elements along one edge of said vane cap plate;

a corresponding series of spaced second hinge elements along one edge of said deflector shield, alternately aligned with said first hinge elements and pivotally interconnected therewith.

7. In the snow blower of claim 1, the adjustable supporting of said pitch-adjusting handle including an apertured strap interlockingly receiving said pitch-adjusting handle and suspended from and secured to said framework lift handle;

and a coiled spring interconnecting said pitch-adjusting handle and vane cap plate.

8. In the snow blower of claim 7, said strap including a pair of spaced upwardly converging sides;

there being a series of pairs of upwardly converging undercut slots in said pitch-adjusting handle selectively receiving said strap sides respectively.

9. In the snow blower of claim 1, said deflector shield normally having a uniform radius of curvature;

said pitch-adjusting handle having a fixed pivotal connection to said shield centrally thereof, whereby upon lateral movement of said vane shifter plate and connected vane cap plate, said connection of said pitch-adjusting handle to said shield causing a torsional twisting of said deflector shield, decreasing its radius of curvature adjacent one end thereof in the direction of shifting and increasing the radius of curvature thereof adjacent its other end, providing a rifling snorkel effect increasing the velocity of said streams of snow.

10. In the snow blower of claim 1, the pivotal connection of said pitch-adjusting handle to said shield including a pair of opposed elongated reinforcing bracket straps mounted on and secured to said deflector shield centrally and longitudinally thereof;

the adjacent inner ends of said latter straps being outturned, receiving and connected to said pitch-adjusting handle.

11. In a transportable snow blower having a framework with a lift handle, a laterally adjustable vane shifter plate, and a series of parallel spaced angularly shiftable upright vanes for delivering streams of snow forwardly and laterally between a pair of side plates;

the improvement of a snow deflector shield assembly comprising an elongated laterally extending vane cap plate overlying and operatively connected to said vanes and laterally adjustable therewith;

a flexible forwardly arcuate deflector shield along one edge hingedly connected to said cap plate along one edge thereof;

overlying said vanes and extending laterally outward of said side plates;

and a pitch-adjusting handle at right angles to and at one end pivotally connected to said deflector shield and intermediate its ends adjustably supported and anchored upon said framework lift handle.

* * * * *